US005275331A

United States Patent [19]

Chung-Piao

[11] Patent Number: 5,275,331

[45] Date of Patent: Jan. 4, 1994

[54] FOLDABLE CONTAINER WITH ONE-STEP UNFOLDING OPERATION

[76] Inventor: Tsao Chung-Piao, 1F, No. 9, Wu-Kung 5th Rd., Wu-Ku Industrial Zone, Hsin Chuang City, Taipei Hsien, Taiwan

[21] Appl. No.: 62,215

[22] Filed: May 18, 1993

[51] Int. Cl.[5] ..... B65D 5/46

[52] U.S. Cl. ..... 229/117.15; 229/117; 229/117.14

[58] Field of Search ..... 229/117, 117.14, 117.15, 229/117.22, 183

[56] References Cited

U.S. PATENT DOCUMENTS

| | | | |
|---|---|---|---|
| 683,532 | 10/1901 | Wagnitz | 229/183 |
| 1,624,439 | 4/1927 | Senat | 229/117.14 |
| 1,982,962 | 12/1934 | McAleer | 229/117.22 |
| 2,066,753 | 1/1937 | Weiss | 229/117 |
| 2,348,378 | 5/1944 | Goodyear | 229/117 |
| 2,685,402 | 8/1954 | Caster | 229/117.14 |
| 3,166,235 | 1/1965 | Schroeder | 229/117.14 |
| 3,927,824 | 12/1975 | Razziano | 229/117 |
| 4,187,976 | 2/1980 | Mather | 229/117 |
| 4,899,929 | 2/1990 | Grollman | 229/117 |
| 5,118,034 | 6/1992 | Tsao | 229/118.14 |

FOREIGN PATENT DOCUMENTS

| | | | |
|---|---|---|---|
| 591993 | 10/1977 | Switzerland | 229/117.14 |

*Primary Examiner*—Gary E. Elkins

[57] ABSTRACT

A foldable container includes a main bottom leaf generally rectangular shaped having an area generally equivalent to a bottom opening of the container and hingedly connected to a side wall, three small bottom leaves respectively hingedly connected to three remaining side walls having one small bottom leaf of the three small bottom leaves hingedly connected to the main bottom leaf and two other small bottom leaves hingedly connected with each other, whereby upon opening of a folded container comprised of such side walls and flaps, the main bottom leaf is fully evected to rest upon the remaining three bottom leaves for completely shielding the bottom opening of the container and the four side walls are opened to be a shape of rectangular tetrahydron.

7 Claims, 9 Drawing Sheets

FOLDABLE CONTAINER WITH ONE-STEP UNFOLDING OPERATION

BACKGROUND OF THE INVENTION

P.A. Shoudy disclosed an edible material container in his U.S. Pat. No 2,596,087 comprising four interconnected side walls, several top closure flaps on the upper edges of two opposite side walls integrally hinged with respect to the side walls, and several bottom flaps 15, 16, 17 and 18 formed integrally with the respective side walls 11, 12, 13 and 14, which however may still have the following drawbacks:

1. After setting up the container by engaging the end 26 of the flap 16 with the recessed portion 24 between the two projecting portions 23 of the flap 18 and with the two reduced end portions 21, 22 of the two bottom flaps 15, 17, the end 26 of the flap 16 is too short to be stably and effectively locked by other bottom flaps 18, 15, 17 so that once loaded with heavy foods, the bottom closure may be leaked or "broken" by disengaging the several bottom flaps 15, 16, 17 and 18 to leak or lose the packed foods material in the container.

2. It requires many steps to set up the bottom closure by engaging the four bottom flaps with one another, causing inconvenience especially when rendered for take-out service in a quick-foods shop.

Therefore, the present inventor invents a container which can be quickly or instantly opened, extended or set up for carrying or storing materials in the container.

SUMMARY OF THE INVENTION

The object oi the present invention is to provide a foldable container including a main bottom leaf generally rectangular shaped having an area generally equivalent to an area of a rectangular bottom opening of the container and hingedly connected to a side wall, three small bottom leaves respectively hingedlY connected to three remaining side walls having one small bottom leaf of the three small bottom leaves hingedly connected to the main bottom leaf and two other small bottom leaves hingedly connected with each other, whereby upon unfolding of a folded container comprised of such side walls and flaps, the main bottom leaf is developed to rest upon the remaining three bottom leaves for completely shielding the bottom opening of the container and the four side walls are erected to form a shape of rectangular tetrahydron simultaneously.

Another object of the present invention is to provide a container having two side-wing members respectively hingedly connected to two opposite side walls of the container, wherein one side-wing member has its interlockable flap operatively interlocked with the respective interlockable flap of the other side-wing member so that the two side-wing members may serve as a stable handle for carrying the container, and wherein each interlockable flap is cut out to form a finger notch for an easy take up of the flap from the side-wing member.

BREIF DESCRIPTION OF THE DRAWINGS

DETAILED DESCRIPTION

Figure 1:
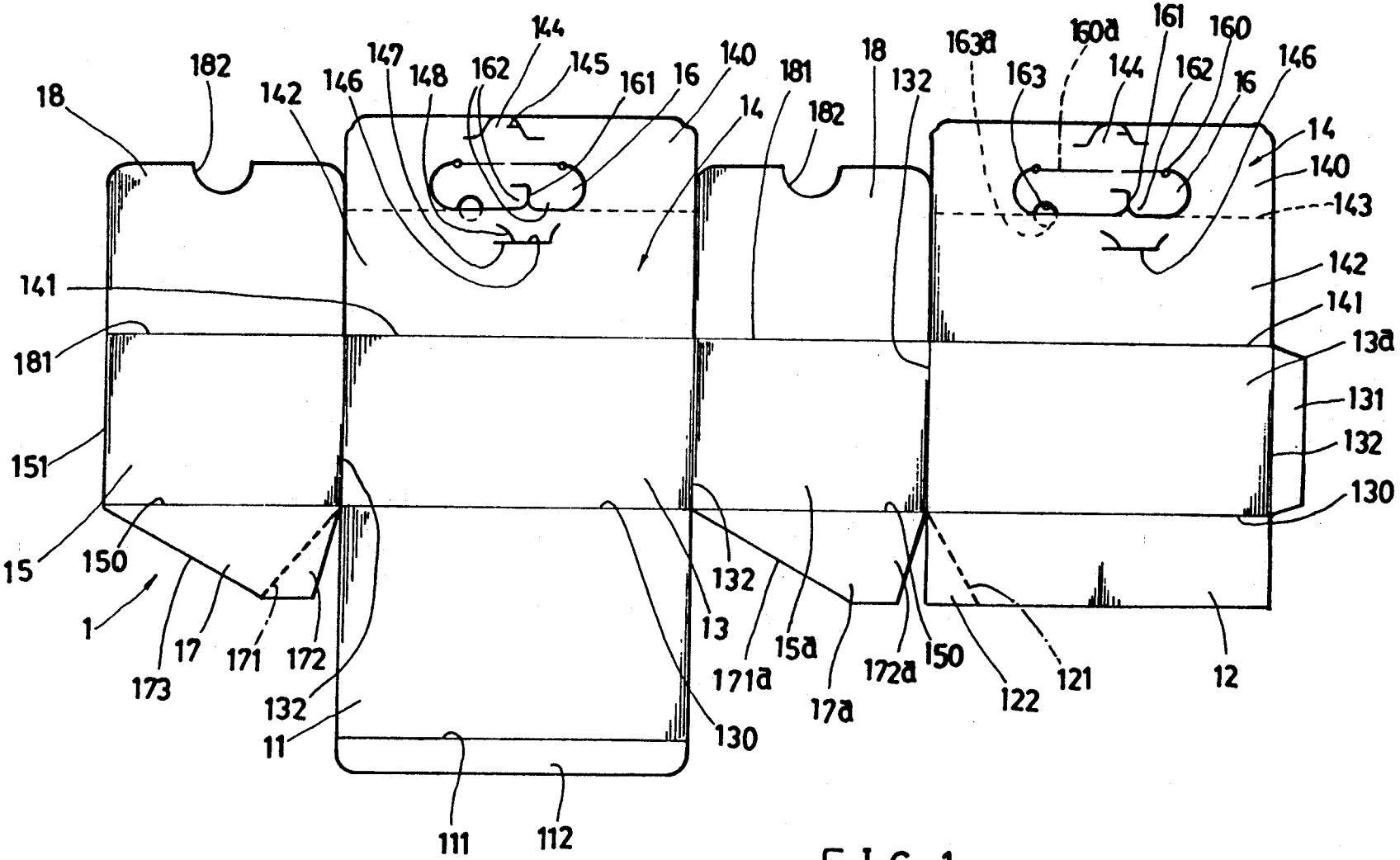
FIG. 1 is an exploded view of the present invention when disassembled.
Figure 3:
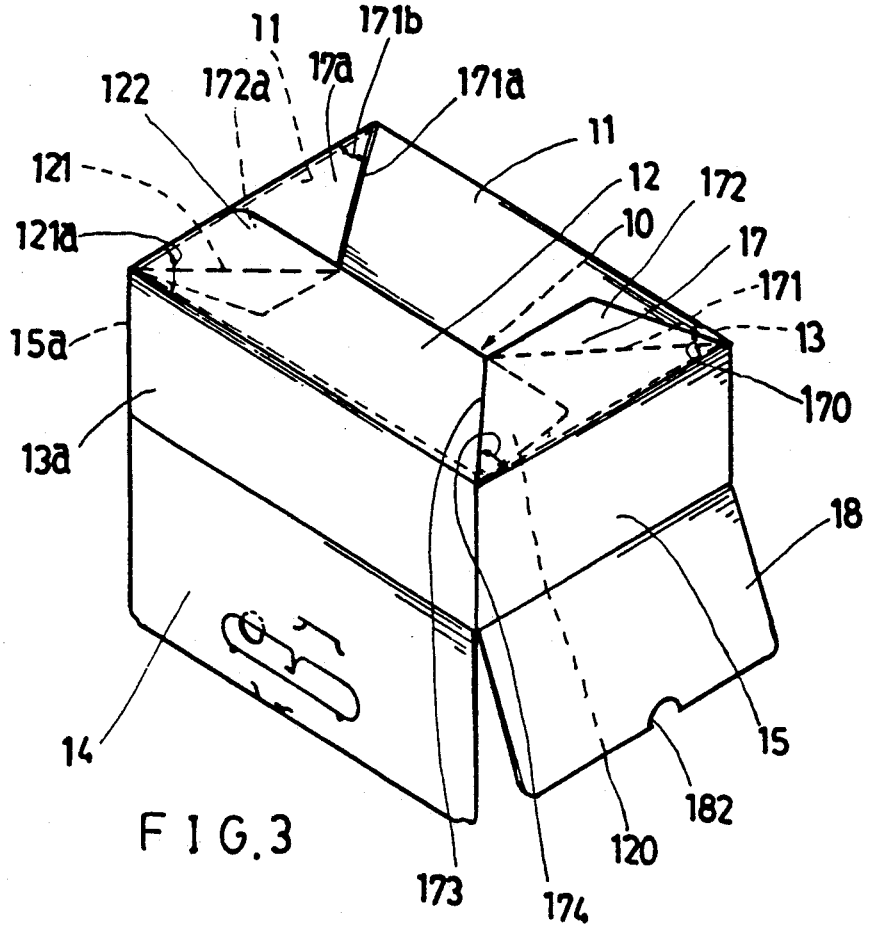
FIG. 3 is a bottom perspective view showing an OPENED container unfolded from FIG. 2.
Figure 14:
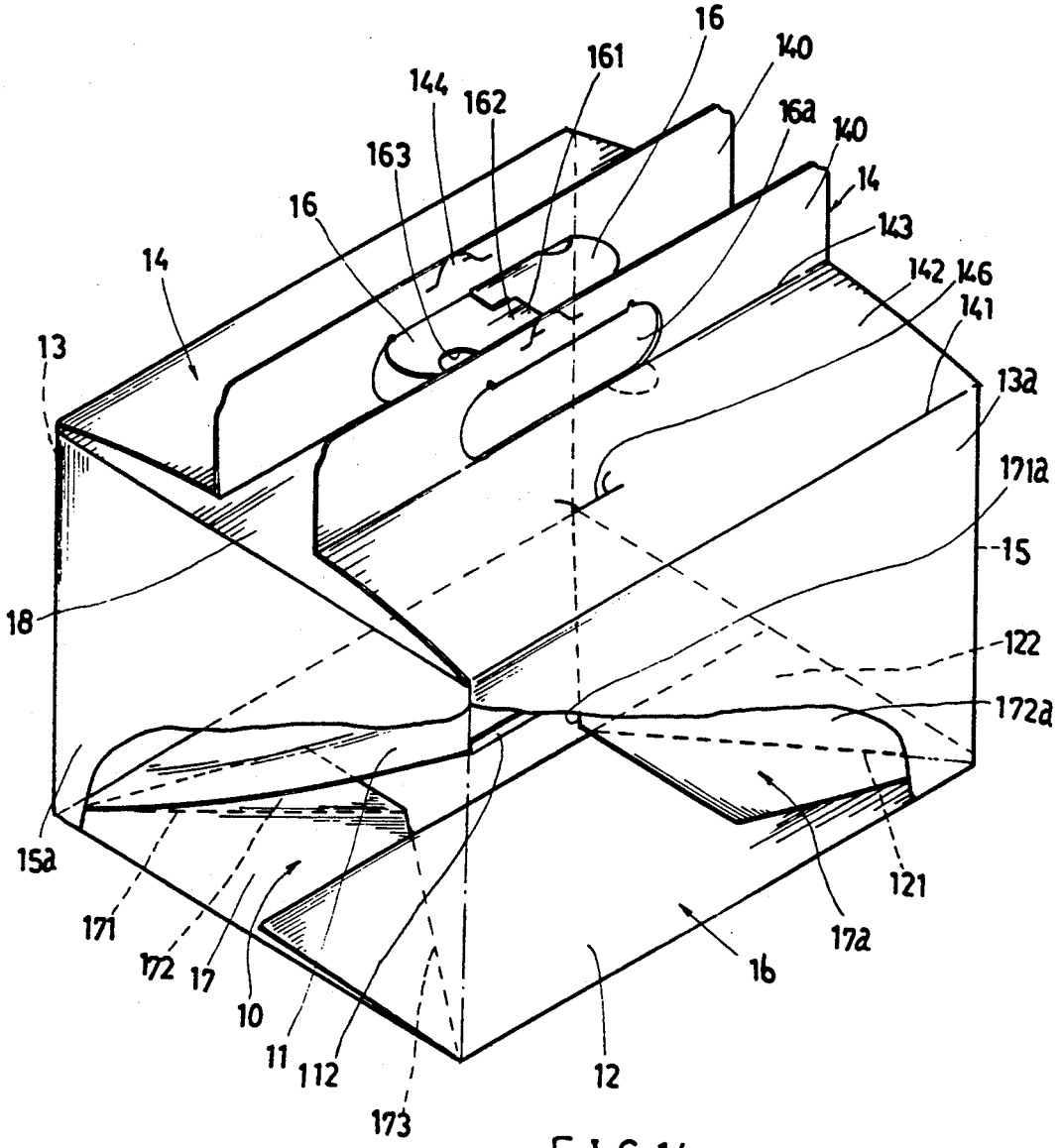
FIG. 14 shows an unfolded portable container for carrying materials.

As shown in FIGS. 1, 3, 5 and 14, the present invention comprises: four side walls 13, 15, 13*a* and 15*a* hingedly interconnected with one another along several vertical tuck lines 132, four bottom leaves 11, 17, 12, 17*a* respectively hingedly secured to the four side walls 13, 15, 13*a* and 15*a*, two half covers 18 respectively hingedly connected to the two side walls 15, 15*a* and two side-wing members 14 respectively hingedly secured to the two side walls 13, 13*a*, which may be disassembled to be an one-piece board 1 as shown in FIG. 1 and can be assembled to form a box-type container by adhering a marginal protrusion 131 formed on a free end edge portion of the side wall 13*a* to another free end edge portion 151 of the side wall 15, by adhering the bottom leaf 17 to the bottom leaf 11, and by adhering the bottom leaf 12 to the bottom leaf 17*a* as shown in FIGS. 3, 14.

The present invention includes a first bottom leaf 11 generally rectangular shaped having an area fully shielding a bottom opening 10 of a container of this invention when erectibly set up for storing materials in the container, having.a bending rim portion 112 operatively bent upwardly along a bending tuck line 111 longitudinally formed on, a free-end edge portion of the first bottom leaf 11 when unfolding the container for storing use, a hinged portion of the first bottom leaf 11 longitudinally connected to a first side wall 13 of the container along a first bottom tuck line 130 longitudinally formed on a bottom portion of the first side wall 13. The first bottom leaf 11 is operatively rested on the remaining three bottom leaves 12, 17, 17*a* when erecting the container.

A second bottom leaf 12 is opposite to the first bottom leaf 1 and having an area not exceeding one half of the area of the first bottom leaf 11, and is hingedly connected to a second side wall 13*a* of the container opposite to the first side wall 13, having a free edge portion 120 operatively rested on a third bottom leaf 17 secured to a third side wall 15 when erecting the container for storing, and a binding zone 122 opposite to the free edge portion 120 of the second bottom leaf 12 and adhered to a fourth bottom leaf 17*a* secured to a fourth side wall 15*a*, and a diagonal tuck line 121 existing on a central divided line in a right-angle zone 121*a* adjacent to the binding zone 122, the right-angle zone 121*a* being projectively defined between the second side wall 13*a* and the fourth side wall 15*a* (FIG. 3).

The third bottom leaf 17 hingedly secured to the third side wall 15 includes a binding zone 172 adhered to the first bottom leaf 11 adjacent to a bottom portion of the first side wall 13, a diagonal tuck line 171 existing on a central divided line in a right angle zone 170 adjacent to the binding zone 172, and a free-end oblique line 173 formed on a free-end edge portion of the third bottom leaf 17 opposite to the diagonal tuck line 171 and intersecting a bottom tuck line 150 of the third side wall 15 with an acute angle 174 generally equal to or less than 45 degrees.

The fourth bottom leaf 17*a* hingedly secured to the fourth side wall 15*a* of the container opposite to the third bottom leaf 17 includes a binding zone 172*a* adhered to a.binding zone 122 of the second bottom leaf 12, a free-end oblique line 171*a* formed on a free-end edge portion of the fourth bottom leaf 17*a* opposite to the binding zone 172*a* of the fourth bottom leaf 17*a* and intersecting a bottom tuck line 150 of the fourth side wall 15*a* with an acute angle 171*b* generally equal to or less than 45 degrees.

Each half cover 18 is hingedly secured to either side wall 15, 15*a* along a tuck line 181 and having a finger notch 182 cut in an edge portion of the cover 18 for easy opening for the half cover 18.

Figure 2:
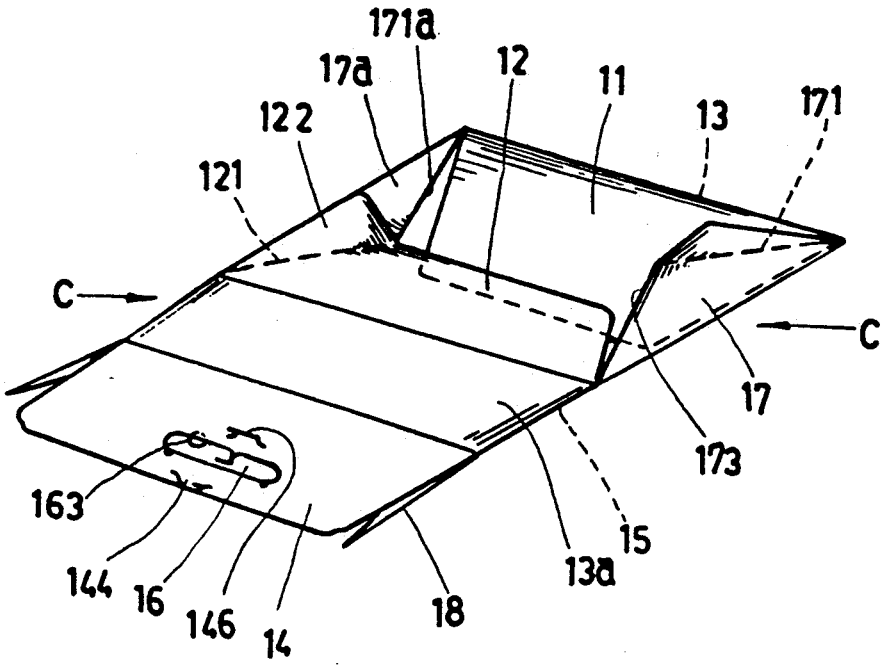
FIG. 2 shows a bottom view of an unfolding step from a folded container in accordance with the present invention.
Figure 4:
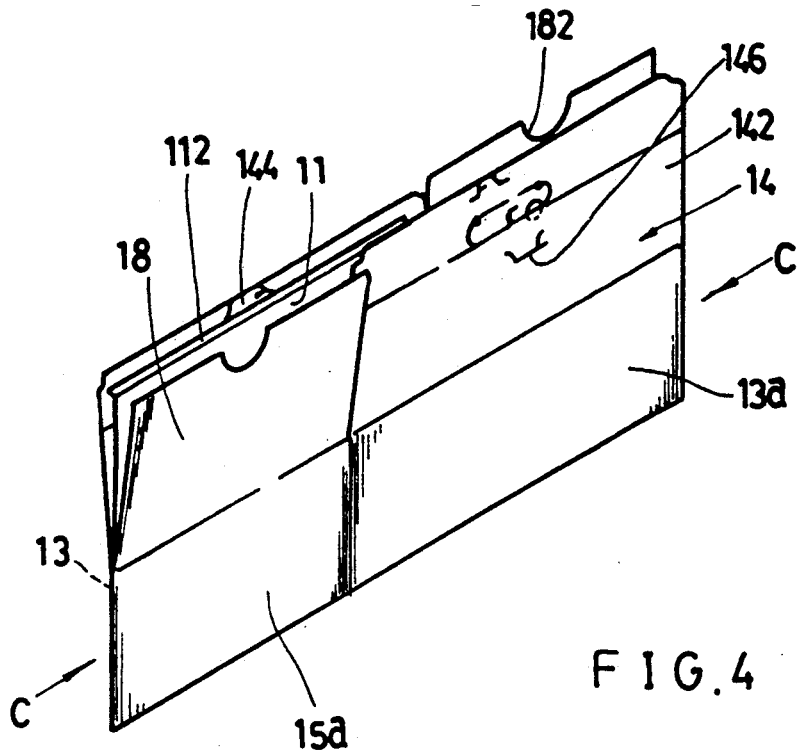
FIG. 4 shows an unfolding step from an elevational view of the present invention.
Figure 5:
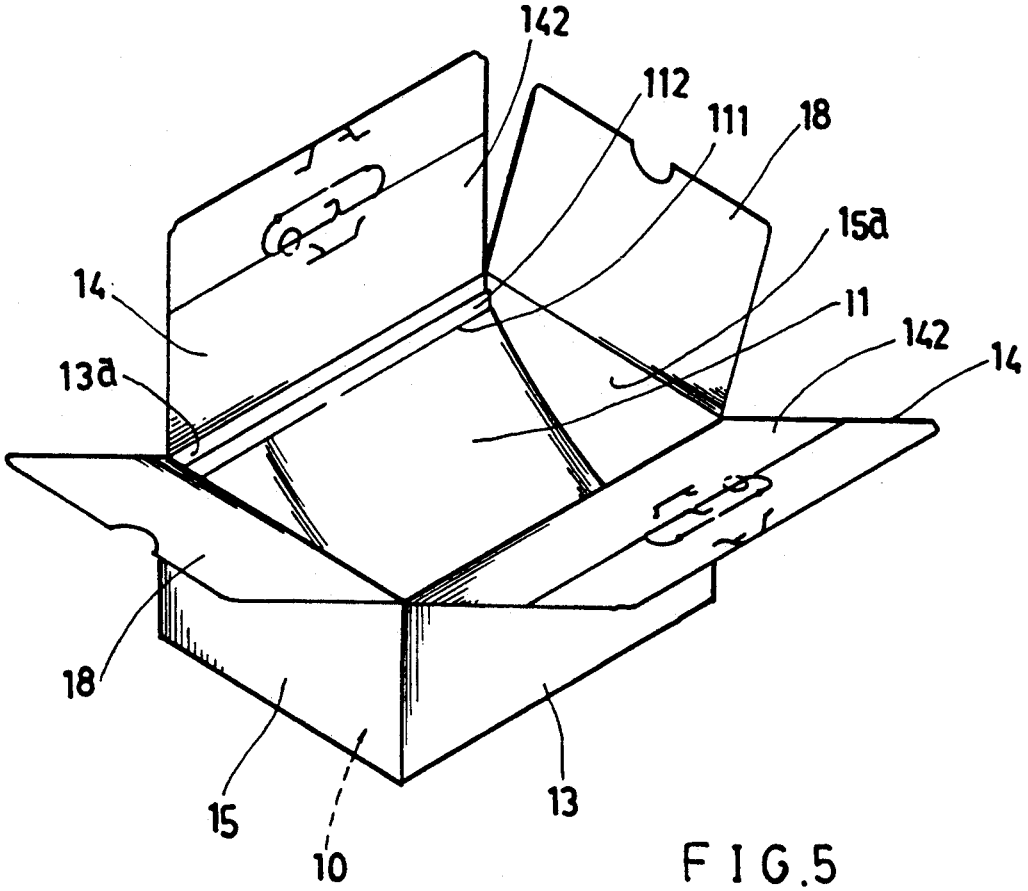
FIG. 5 shows the opened container of the present invention after unfolding operation.
Figure 6:
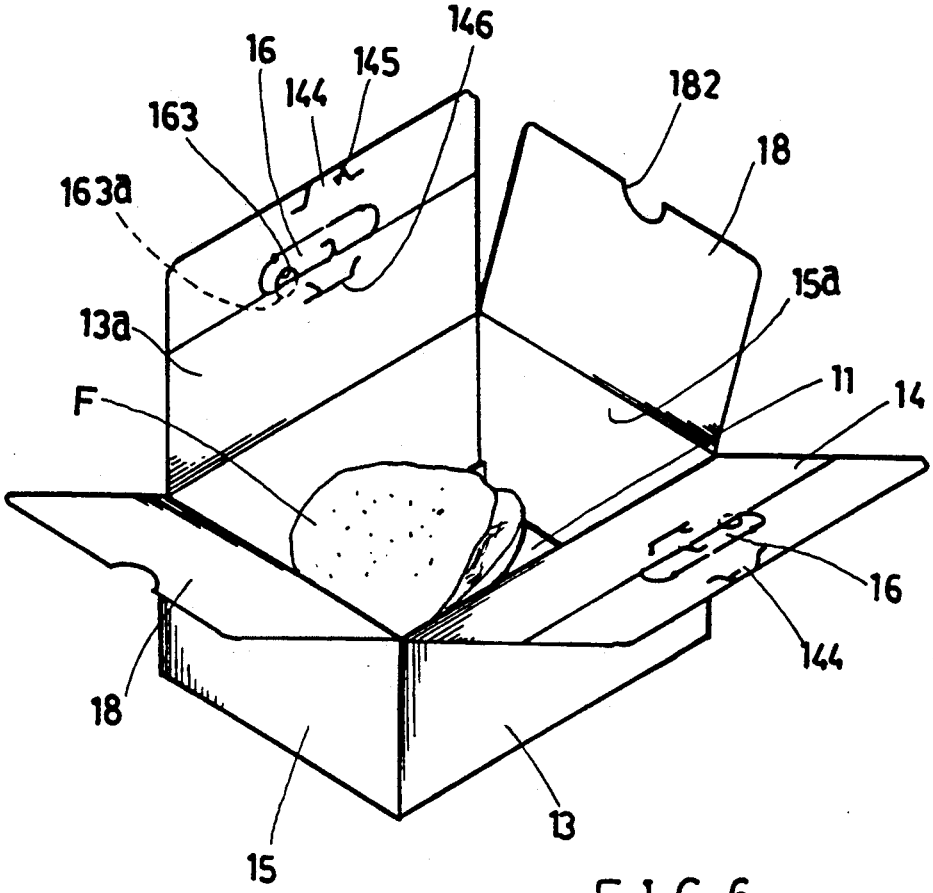
FIG. 6 is an illustration showing a loading of foods in the container.
Figure 7:
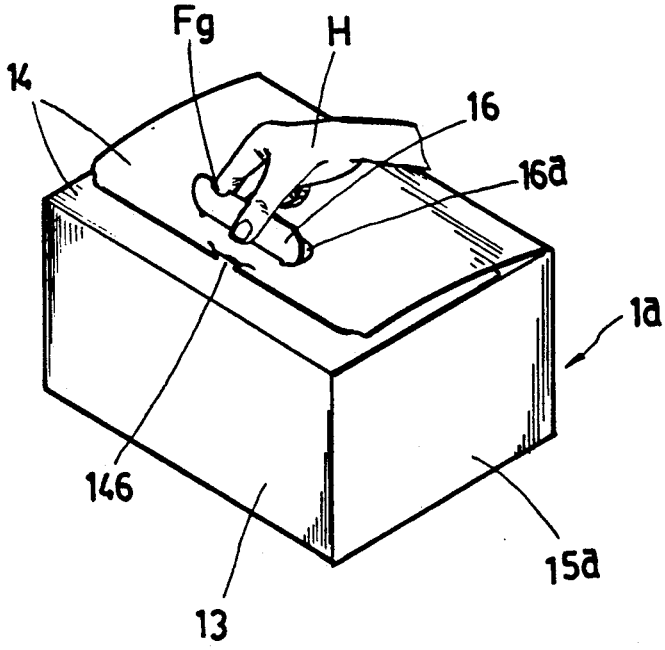
FIG. 7 shows a closed flattened container in accordance with the present invention.
Figure 8:
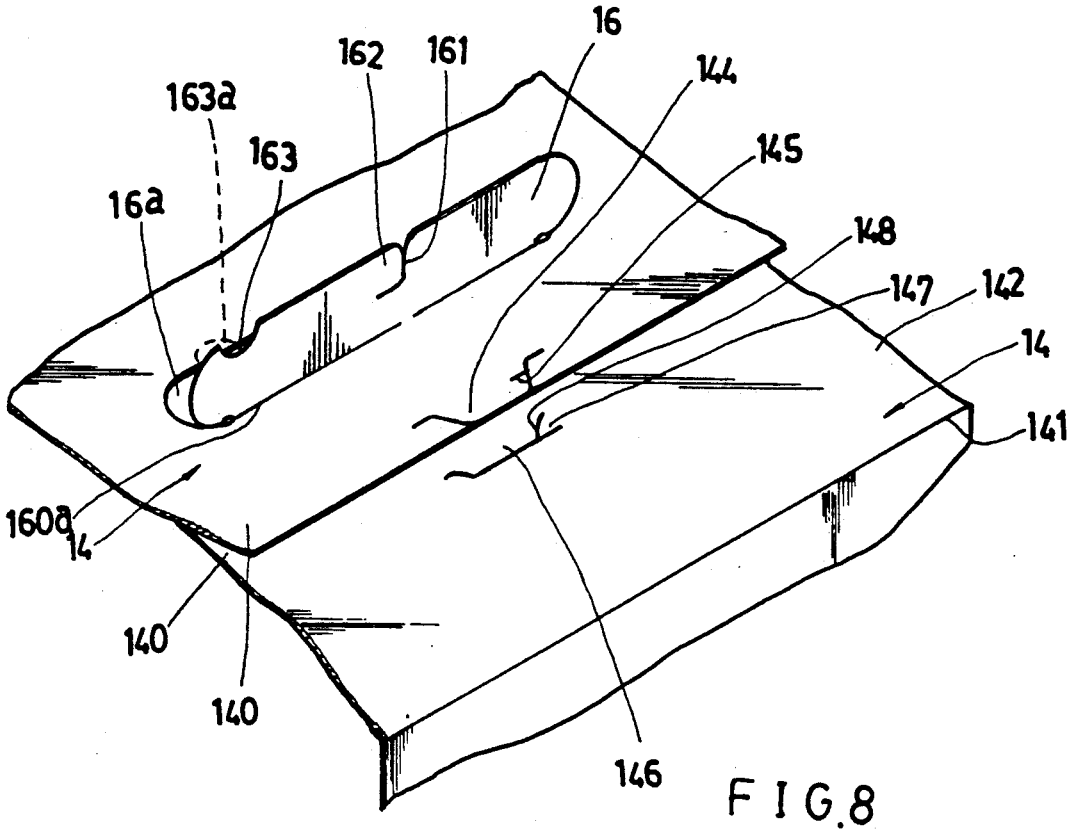
FIG. 8 shows a finger notch cut in the handle portion of the present invention.
Figure 10:
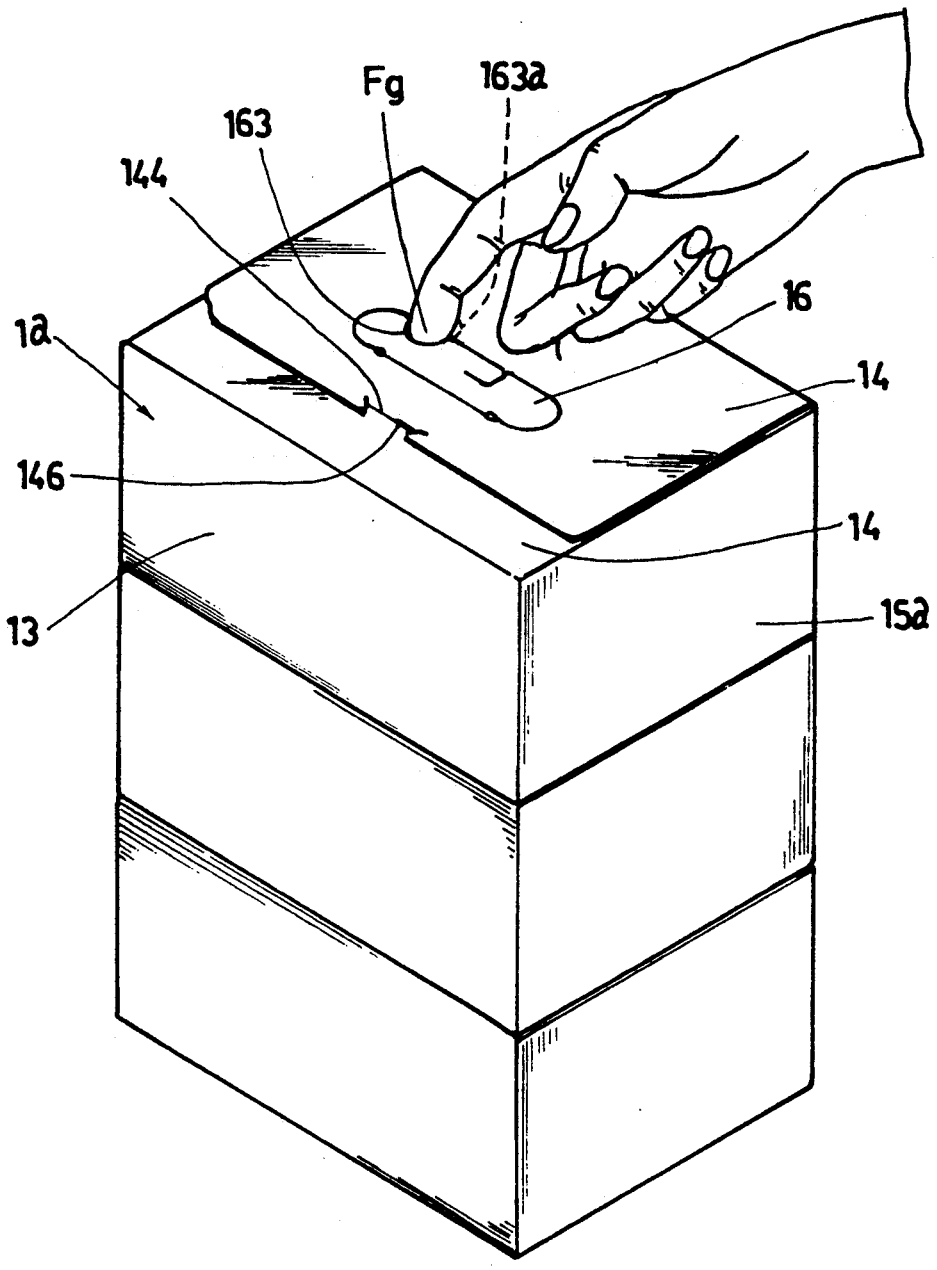
FIG. 10 shows a stocking condition when overlapping the flattened containers as shown in FIG. 7.
Figure 11:
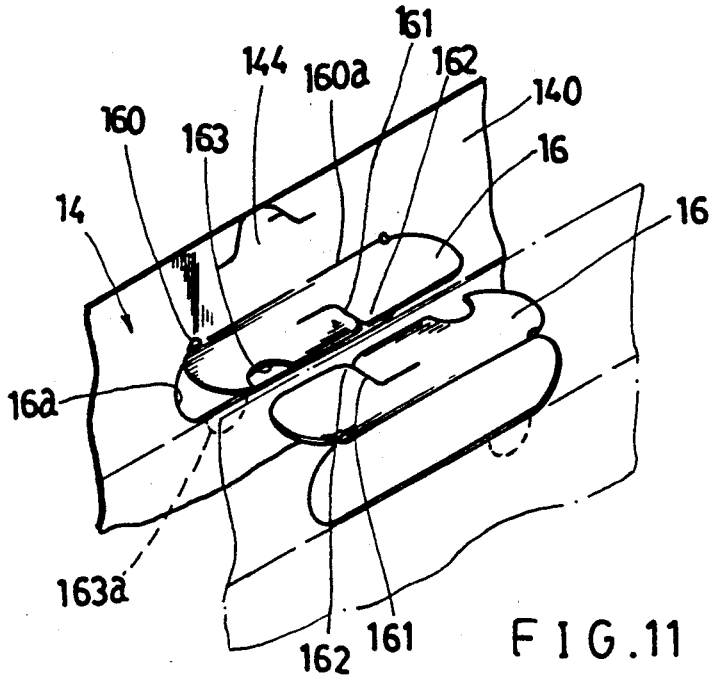
FIG. 11 shows a first interlocking step for the two handle portions of this invention.
Figure 12:
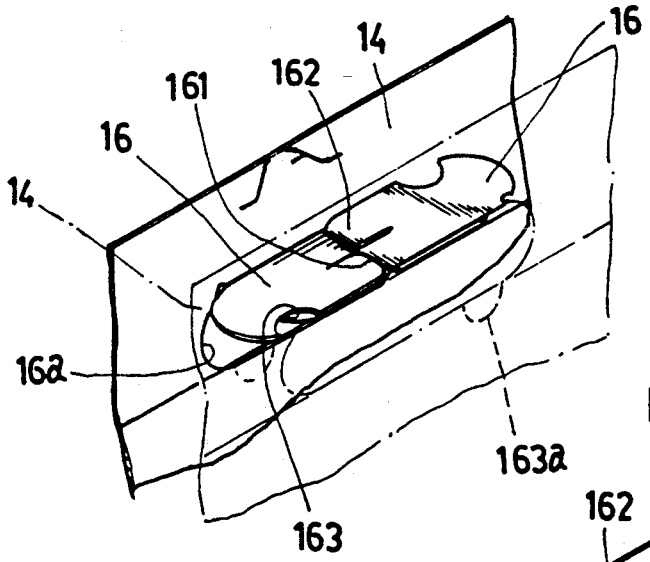
FIG. 12 shows a second interlocking step.

When the container of this invention is folded or collapsed as shown in FIG. 4, the bottom leaves 11, 12, 17, 17*a* are respectively hingedly folded to touch or approximate their respective connected side walls, namely, side walls 13, 13*a*, 15 and 15*a* and the bottom leaves are folded along the tuck lines 171, 121. Upon unfolding of the container as shown in FIGS. 4, 2, the first leaf 11 will be developed downwardly with one-step operation to rest on the opened bottom leaves 12, 17 and 17*a* for quick opening or setting up of the container, on which any foods F is loaded to further lower the first leaf 11 until stablY retained by the other unfolded leaves 12, 17, 17*a* as shown in FIG. 7. Then the two half covers 18 are closed on the upper portions of all side walls 13, 13*a*, 15, 15*a*, and the two side-wing members 14 are raised to serve as a handle forming a portable container 1*b* to be carried by a user's hand H as shown in FIGS. 14, 15 or just flattened to form a flattened container 1*a* as shown in FIG. 7 for serving as a closed package adapted for stacking storage as shown in FIG. 10.

Figure 13:
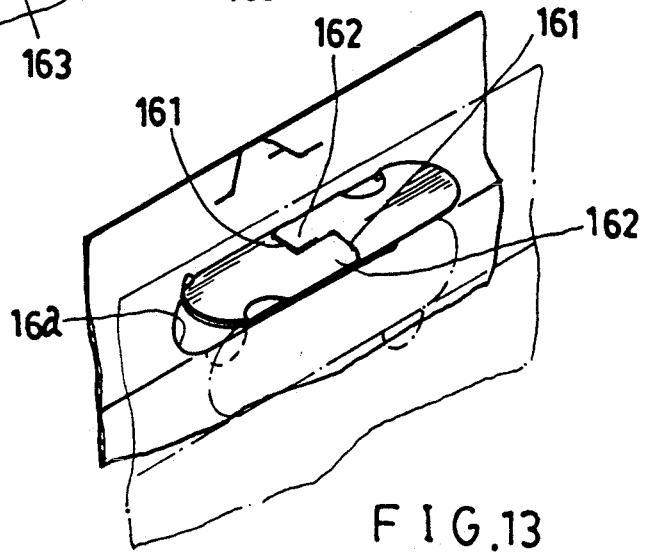
FIG. 13 shows an interlocked condition of the two handle portions of this invention.
Figure 15:
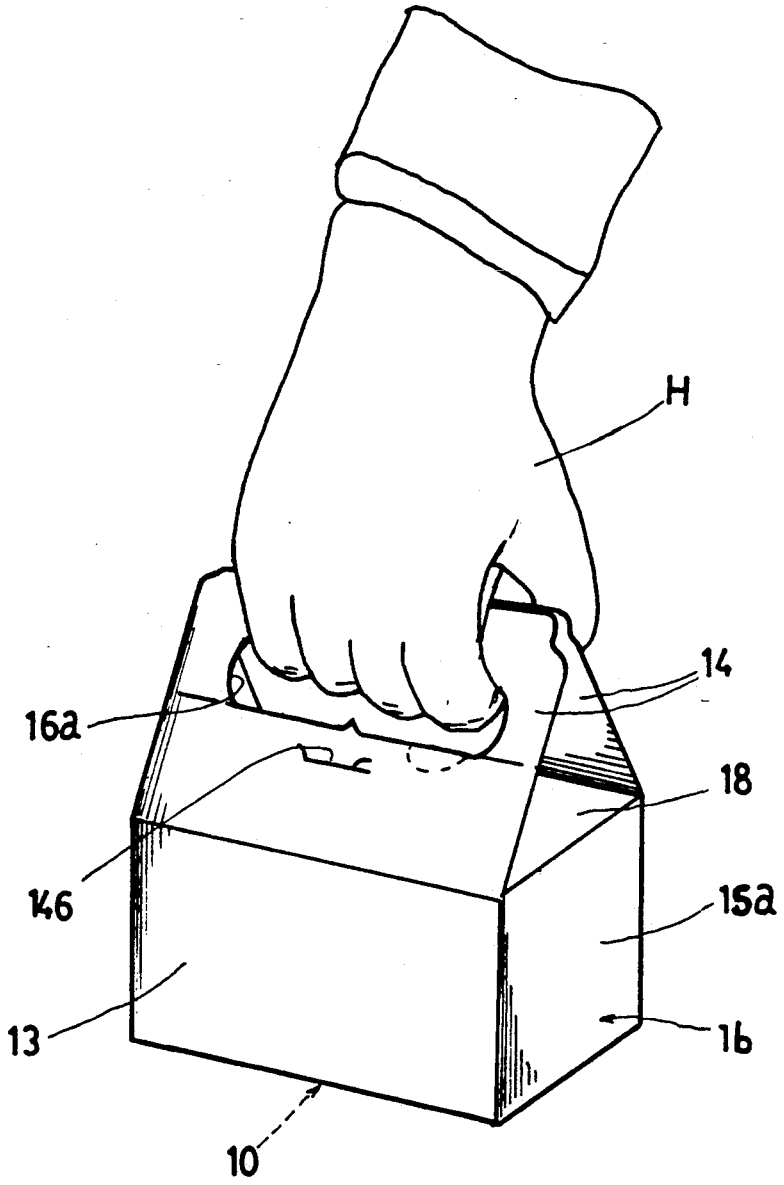
FIG. 15 is an illustration showing the portable container carried by someone's hand.

Each side-wing member 14 includes a convergent wing portion 142 defined between a convex wing tuck line 141 formed on a top edge portion of either first or second side wall 13, 13*a*, and a concave wing tuck line 143 formed in between the convergent wing portion 142 and a handle portion 140 formed on a free-end edge portion of the side-wing member 14, an interlockable flap 16 protruding downwardly from a flap tuck line 160*a* formed on an edge portion of a handhole cutout 16*a* formed in the handle portion 140, a T-shaped slit 161 notched in a central edge portion of the flap 16 to form a pair of separated locking tabs 162 on an inner edge portion of the flap 16 so that a left locking tab 162 of one side-wing member may be interlocked with a right locking tab 162 of the other side-wing member as shown in FIGS. 13, 14 for linking the two handle portions 140 for carrying the container by poking a user's hand H through the cutout 16*a* as shown in FIGS. 14, 15. A stress-immune perforation 160 is formed at an intersected point crossed by the tuck line 160*a* and the flap 16. Each handle portion 140 is further formed with an embedding tongue member 144 on an outer edge portion of the handle portion 140, and each side-wing member 14 is formed with a tongue-receiving slit 146 generally pi-shaped ($\pi$) in a convergent wing portion 142 of the side-wing member 14 so that a right tongue member 144 may be engageably inserted into a left tongue-receiving slit 146 for planarly embedding a right handle portion 140 on a left handle portion 140 as shown in FIGS. 9, 10 for stacking a plurality of layers of the containers 1*a*.

Figure 9:
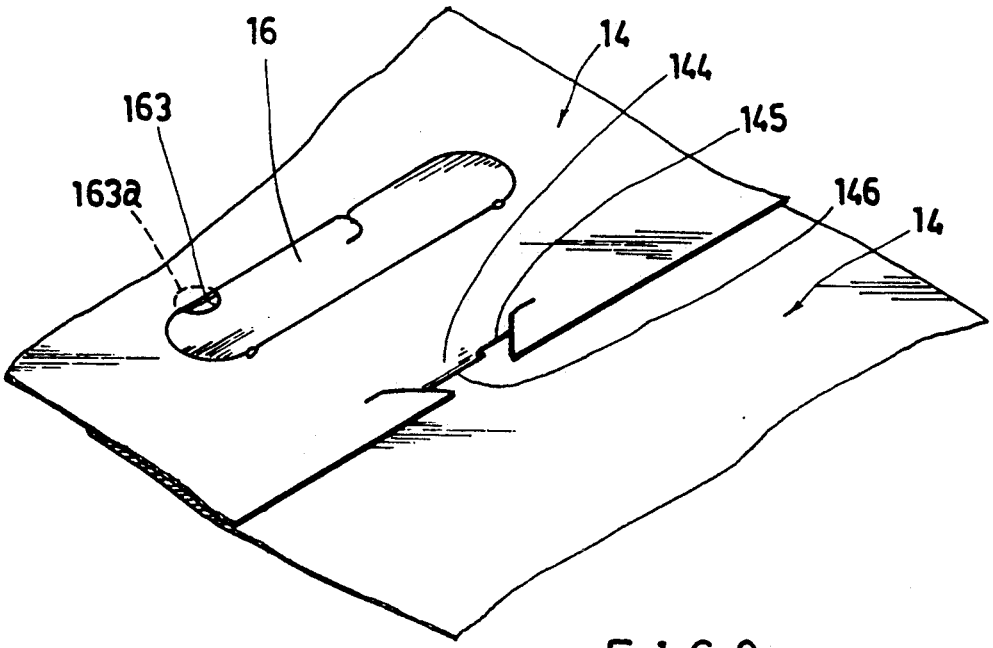
FIG. 9 is a partial illustration of a flattened condition when engaging one handle portion with the other handle portion of this invention.

The slit 146 includes a linear slit 147 for locking the tongue member 144, and a pair of arcuate slits 148 generally perpendicular to the linear slit 147 adapted for an easy insertion of the tongue member 144 into the slits 148, 147 of the tongue-receiving slit 146 for locking a tongue tip portion 145 cut in the tongue member 144 in the linear slit 147 as shown in FIG. 9.

A finger notch 163 is cut in a free-end edge portion of each interlockable flap 16 for an easy opening of the flap 16. An auxiliary finger notch 163*a* may also be notched in the handle portion 140 adjacent to the flap 16 for an easy take-up or opening of the flap for portable purpose.

The present invention provides a container for stably, conveniently storing foods, or any other materials, objects or products in the container, with a quick opening or extending ("one-step") operation, with an easY set-up of the interlocked flaps by a user's finger Fg through the finger notches 163, 163*a* for carrying purpose, and upon insertion of a tongue member 144 of one handle portion into a tongue slit 146 of the other handle portion for flattening and stacking the containers.

I claim:

1. A foldable container comprising:

four side walls including a first, a second, a third and a fourth side wall, said four side walls hingedly interconnected with one another to form a shape of rectangular tetrahydron when unfolded, four bottom leaves including a first, a second, a third, and a fourth bottom leaf, said four bottom leaves respectively hingedly connected with the four side walls, two half covers hingedly secured to two opposite side walls of said four side walls for covering an upper opening of the container when unfolded, and two side-wing members hingedly secured to the other two opposite side walls of said four side walls and operatively interlocked to serve as a handle for carrying the container when unfolded for storing material therein, said first bottom leaf generally rectangular shaped having an area operatively shielding a bottom opening of the container when unfolded from said first side wall, said first bottom leaf having a bending rim portion operatively bent upwardly along a bending tuck line longitudinally formed on a free-end edge portion of the first bottom leaf when erecting the container for storing use, and a hinged portion longitudinally connected to said first side wall of the container along a first bottom tuck line longitudinally formed on a bottom portion of the first side wall, whereby upon unfolding of said container, said first bottom leaf will be unfolded to rest upon said second, third and fourth bottom leaves of the respective second, third and fourth side walls for a stable set-up and opening of the container for storing use.

2. A foldable container-according to claim 1, wherein said second bottom leaf is opposite to the first bottom leaf and has an area not exceeding one half of an area of the first bottom leaf, said second bottom leaf hingedly connected to a second side wall of the container opposite to the first side wall, said second bottom leaf having a free edge portion operatively rested on said third bottom leaf secured to said third side wall when unfolding the container for storing use, and a binding zone formed on a side portion of the second bottom leaf to be opposite to the free edge portion of the second bottom leaf, said binding zone of said second bottom leaf adhered to said fourth bottom leaf which is secured to said fourth side wall, and a diagonal tuck line existing on a central divided line in a right-angle zone adjacent to the binding zone, said right-angle zone being projectively defined between the second side wall and the fourth side wall of the container.

3. A foldable container according to claim 2, wherein said third bottom leaf hingedly secured to the third side wall having a binding zone of the third bottom leaf adhered to the first bottom leaf adjacent to a bottom portion of the first side wall, a diagonal tuck line existing on a central divided line in a right angle zone adjacent to the binding zone of the third bottom leaf, and a free-end oblique line formed on a free-end edge portion of the third bottom leaf opposite to the diagonal tuck line of the third bottom leaf and intersecting a bottom tuck line of the third side wall with an acute angle generally equal to or less than 45 degrees.

4. A foldable container according to claim 2, wherein said fourth bottom leaf hingedly secured to the fourth side wall of the container opposite to the third bottom leaf includes a binding zone of the fourth bottom leaf adhered to the binding zone of the second bottom leaf, a free-end oblique line formed on a free-end edge portion of the fourth bottom leaf opposite to the binding zone of the fourth bottom leaf and intersecting a bottom tuck line of the fourth side wall with an acute angle generally equal to or less than 45 degrees.

5. A foldable container according to claim 1, wherein each said side-wing member includes a convergent wing portion defined between a convex wing tuck line formed on a top edge portion of each of said first and second side walls, and a concave wing tuck line formed in between the convergent wing portion and a hangle portion formed on a free-end edge portion of the side-wing member, an interlockable flap protruding downwardly from a flap tuck line formed on an edge portion of a handhole cutout formed in the handle portion, a T-shaped slit notched in a central edge portion of the interlockable flap to form a pair of separable locking tabs on an inner edge portion of the flap to allow a left locking tab of one side-wing member to be interlocked with a right locking tab of the other side-wing member for linking the two handle portions for carrying the container, each said interlockable flap cut with a finger notch in a free-end edge portion of each said interlockable flap for easy opening of the interlockable flap.

6. A foldable container according to claim 5, wherein said container has an auxiliary finger notch notched in each said handle portion and positioned adjacent to said finger notch in said interlockable flap for an easy take-up or opening of each said interlockable flap.

7. A foldable container according to claim 5, wherein each said handle portion is formed with an embedding tongue member on an outer edge portion of the handle portion, and each said side-wing member is formed with a tongue-receiving slit generally pi- shaped in each said convergent wing portion of the side-wing member so that the tongue member of a right handle portion is engageably inserted into the tongue-receiving slit of a left handle portion for planarly embedding the right handle portion on the left handle portion for stacking purpose, each said tongue-receiving slit including a linear slit and a pair of arcuate slits generally perpendicular to the linear slit adapted for easy insertion and locking of each said tongue member of one interlockable flap into each said tongue-receiving slit of the other interlockable flap.

* * * * *